United States Patent [19]

Fjellstrom

[11] Patent Number: 4,932,639

[45] Date of Patent: Jun. 12, 1990

[54] DOOR AND BODY JACK

[75] Inventor: Norm Fjellstrom, Foam Lake, Canada

[73] Assignee: TAC Manufacturing Inc., Wadena, Canada

[21] Appl. No.: 383,529

[22] Filed: Jul. 24, 1989

[51] Int. Cl.[5] ..... B66F 3/00

[52] U.S. Cl. ..... 269/17; 254/100; 269/60; 269/71

[58] Field of Search ..... 269/17, 296, 60, 130, 269/131, 71, 79, 904, 905; 254/100, 133, 134, 131, 2 B, 8 B; 72/705; 414/11, 10, 589, 590

[56] References Cited

U.S. PATENT DOCUMENTS

| | | | |
|---|---|---|---|
| 2,669,422 | 2/1954 | Branich | 254/2 B |
| 2,908,403 | 10/1959 | Browder, Jr. et al. . | |
| 3,220,565 | 11/1965 | Wells . | |
| 3,858,864 | 1/1975 | Waldow . | |
| 3,892,385 | 7/1975 | Andrist et al. | 254/133 R |
| 3,964,729 | 6/1976 | Harlow | 254/131 |
| 4,029,308 | 6/1977 | Mathers . | |
| 4,042,208 | 8/1977 | Arakaki | 254/134 |
| 4,180,252 | 12/1979 | Cushenbery . | |
| 4,183,511 | 1/1980 | Marek | 269/17 |
| 4,463,937 | 8/1964 | Celette . | |
| 4,530,492 | 7/1985 | Bork . | |
| 4,690,605 | 9/1987 | Coccard | 254/8 R |
| 4,810,151 | 3/1989 | Shern | 269/17 |

*Primary Examiner*—Robert C. Watson

*Attorney, Agent, or Firm*—Murray E. Thrift; Stanley G. Ade; Adrian D. Battison

[57] ABSTRACT

An apparatus supports automobile body parts for removal, installation or servicing. The apparatus includes a T-shaped dolly support and a vertical standard on which a support unit slides. The support unit includes a cross arm with cradles at its opposite ends for engaging under a body part to be handled and a head above the cradle which carries a clamp for securing a hook-carrying webbing strap to the support unit. A resilient bumper strip extends from the head to the cross arm. The position of the support unit is adjusted along the standard with a screw jack positioned behind the standard. The strap and hook assembly engages a part to be handled and draws it against the resilient bumper strip providing a stable support for the part. The cross arm is preferably tiltable from one side to the other. The apparatus can be used in conjunction with a wheel well adapter for supporting fenders and truck boxes.

17 Claims, 4 Drawing Sheets

DOOR AND BODY JACK

FIELD OF THE INVENTION

The present invention relates to apparatus for supporting automobile body parts.

BACKGROUND

In the repair and servicing of automobiles, it is often necessary to support body parts, for example, doors, bumpers, pick-up truck boxes and so on, independently from the remainder of the vehicle. Various devices have been proposed for this purpose in the past. These are predominantly special purpose devices for handling a single type of body part, for example, vehicle doors. Others have been excessively complex or have had limited capacity, either as to the size or weight of the parts that could be handled.

The present invention is concerned with the provision of a highly flexible, simple apparatus for the handling of automobile body parts.

SUMMARY

According to the present invention there is provided an apparatus for supporting parts of automobile bodies comprising:

(a) a base including means for supporting the base for travel over a floor;

(b) a standard secured to the base and extending upwardly therefrom;

(c) a support unit mounted in the standard for movement up and down along the standard, the support unit including:

(i) a cross arm adjacent the bottom end of the support unit and carrying cradle means for supporting a body part from below;

(ii) a head spaced above the cross arm and including an elongate flexible tension means, a body part engaging hook means carried by the tension means and a clamp for selectively clamping the tension means to the support unit, and (iii) resilient bumper means extending between the cross arm and the head for engaging a body part and biasing the part away from the head whereby tension is applied to the tension means; and (d) jack means mounted on the base and coupled to the support unit for selectively viewing and lowering the support unit on the standard.

In use, the body parts to be handled are supported on the cradle and are drawn against the resilient bumper by the flexible tension means. This provides a stable support for body parts of various sizes and configurations. The preferred embodiments of the invention are capable of handling parts ranging in size from bumpers to the sliding doors of vans. If used in pans, the units can handle pick-up truck boxes and cabs.

It is preferred that the standard is a vertical square tube with the support unit including a head section that slides in the standard and a cross arm section with a sleeve that slides on the outside of the standard. The two support unit sections are connected by a vertical tube that is raised and lowered on the base using an internal screw jack.

BRIEF DESCRIPTION OF THE DRAWINGS

In the accompanying drawings, which illustrate an exemplary embodiment of the present invention.

DETAILED DESCRIPTION

Figure 1:
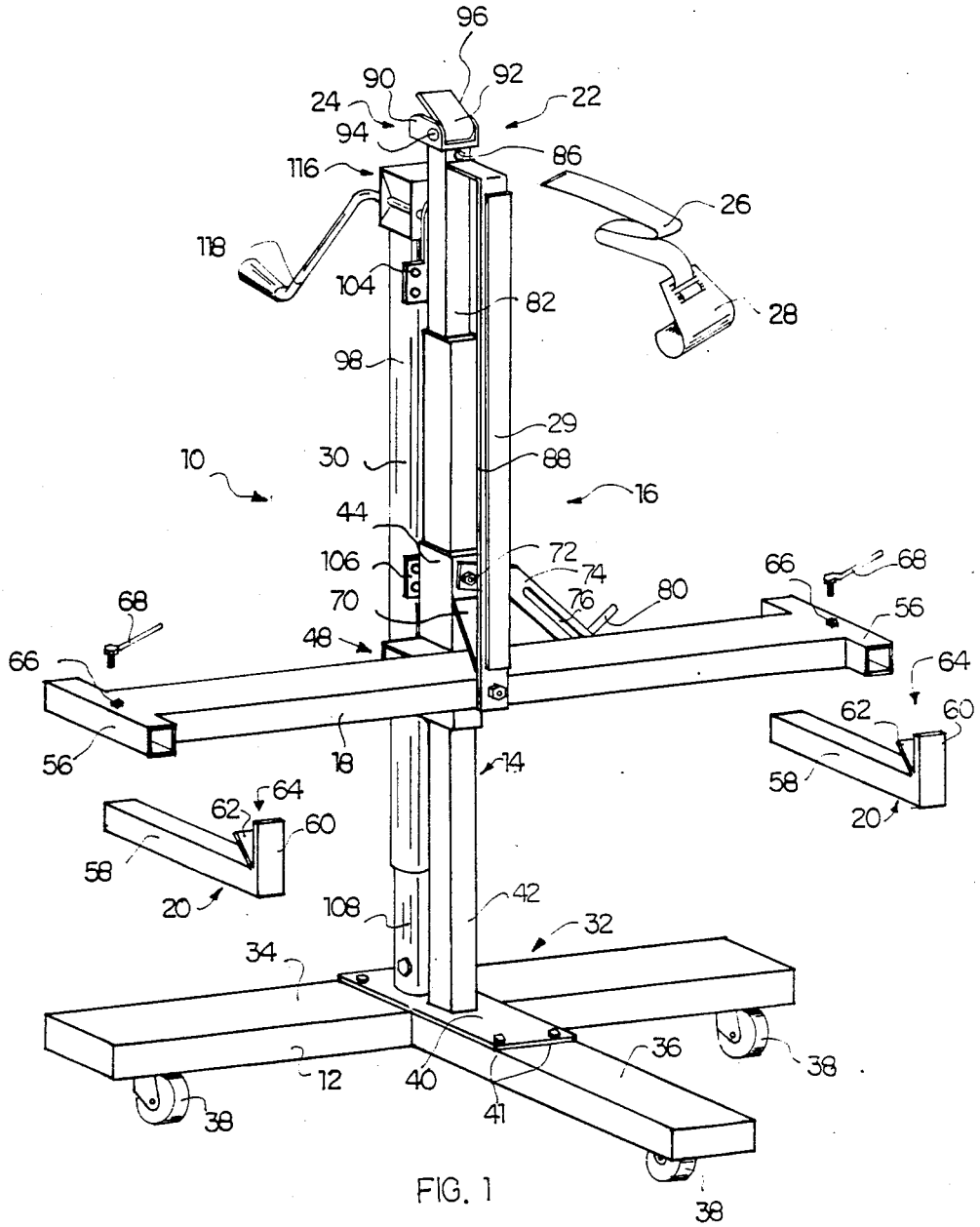
FIG. 1 is an isometric view of one embodiment of the present invention.

Referring to the accompanying drawings, there is illustrated a body part handling apparatus 10 that includes a base 12 supporting a vertical standard 14. A body part support unit 16 slides up and down on the standard 14. It includes a cross arm 18 carrying two laterally spaced cradles 20 and a head 22 that includes a belt clamp 24 for clamping a belt 26 to the support unit. The belt 26 carries a body part engaging hook 28. The head 22 and the cross arm 18 are joined by a vertical bumper strip 29. A screw jack 30 is mounted on the base behind the standard 14 to raise and lower the support unit 16 on the standard.

As illustrated most particularly in FIG. 1, the base 12 of the apparatus is a T-shaped dolly 32 with a base arm 34 and a lead arm 36 projecting to the front of the apparatus. The end of each arm is supported on a caster wheel 38.

Figure 2:
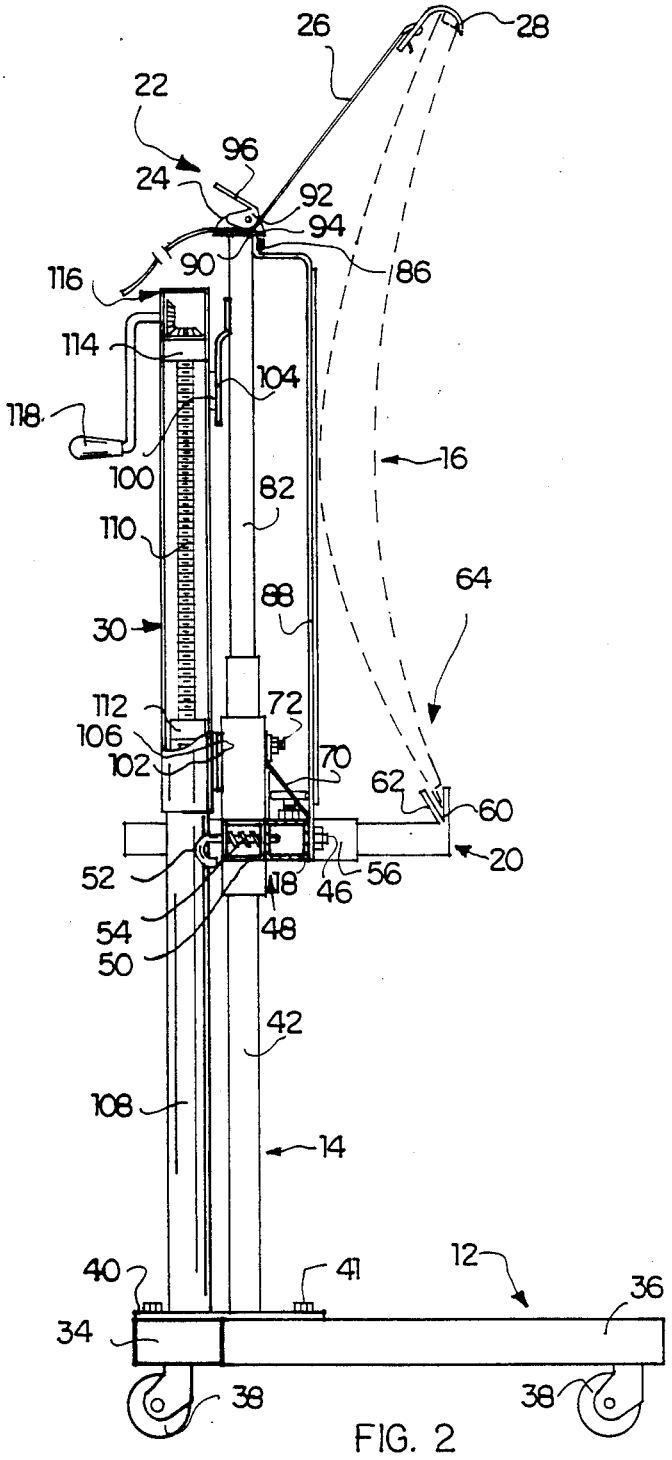
FIG. 2 is a side elevation partially in section of the embodiment of FIG. 1.

On the top of the base is a rectangular plate 40 secured in place by bolts 41 and carrying the standard 14 and screw jack 30. The standard is a square tube 42 that extends vertically from the base immediately in front of the base arm 34. Fitted slideably on the square tube is a mating square sleeve 44. A stud 46 projects from the front of the sleeve 44 through the cross arm 18 to provide a centre pivot for the cross arm. A latch 48 is carried by the tube 42 to latch the cross arm 18 in the horizontal position. The latch consists of a section of square tube 50 projecting laterally from the tube 42 and a latch bolt 52 projecting through the tube 50 from the rear to engage in a mating hole in the cross arm 18. A spring 54 within the tube 50 acts between the tube and the bolt to bias the bolt into the latched position as illustrated in FIG. 2. To release the latch, the bolt is withdrawn towards the back, thus releasing the cross arm to pivot about the stud 46.

At opposite ends of the cross arm 18 are horizontal square sleeves 56 that are horizontally oriented across the ends of the cross arm. Each sleeve carries a respective one of the cradles 20 with a square cradle shank 58 sliding the sleeve. At the front end of the cradle are two plates 60 and 62 providing a support notch 64.

The top of each sleeve 56 is drilled and fitted with a nut 66 to accommodate a T-head set screw for securing the respective cradle 20 in position with respect to the cross arm.

The sleeve 44 is connected to the outer end of the cross arm support stud 46 by an angle brace 70 that extends from a stud 72 near the top of the sleeve to the front of the cross arm where it engages over the stud 46. This provides additional support for the stud 46.

To control pivoting movement of the cross bar 18 when the latch 48 is disengaged, a brace 74 is provided. This is an angled plate with one end connected to the stud 72 and an elongate slot 76 in the opposite end for receiving a stud 78 on the back face of the cross arm. A wing nut 80 on the stud 78 is used to clamp the brace 74 to the cross arm 18. This mechanism allows the cross arm 18 to tilt to one side or the other where necessary to engage body parts that are not horizontally aligned or to orient body parts properly for installation.

Fitted telescopically into the top of the tube 42 is a head tube 82. This carries the head 22 of the support unit. The tube 82 is connected to the top end of the bumper strip 29 by a bolt 86. The bumper strip is spaced to the front of the standard 14 and extends down to the cross arm, where it is connected to the stud 46. The strip 29 is covered on its front face with a strip of cushioning material 88.

The clamp 24 of the head 22 consists of a short channel section 90 secured to the top of the tube 82. Within the channel is a broad cam 92 mounted on a lateral pivot 94. A plate 96 extends from the cam upwardly and to the rear so that as the plate 96 is drawn down to the rear, the cam approaches the base of the channel to clamp the strap 26 to the head 22. The strap 26 is a webbing strap that frictionally engages the cam 92 and the base of the channel so that tension on the strap towards the front of the apparatus will act to draw the cam into a tighter clamping action. The clamp is, nonetheless, a "quick release" clamp.

The screw jack 30 positioned behind the standard 14 includes a support tube 98 carrying a pair of plates 100 and 102 that are bolted to plates 104 and 106 respectively carried by the head tube 82 and the cross arm sleeve 44. Thus, the support tube 98, the head 22 and the cross arm 18 all form a single unit that may move up and down on the standard 14. Telescoped within the support tube 98 is a jack tube 108 secured to the plate 40. A lead screw 110 extends along the centre of tubes 98 and 108 and engages a nut 112 fixed to the top of the tube 108. The lead screw turns in a bearing 114 at the top of the tube 98. An angle gear drive 116 is fitted on the top of the tube 98 and drives the lead screw 110 by means of a crank 118 at the back of the tube. Rotation of the crank rotates the lead screw and thus raises and lowers the tube 98 and the entire support unit on the tube 108 and standard 14.

Figure 3:
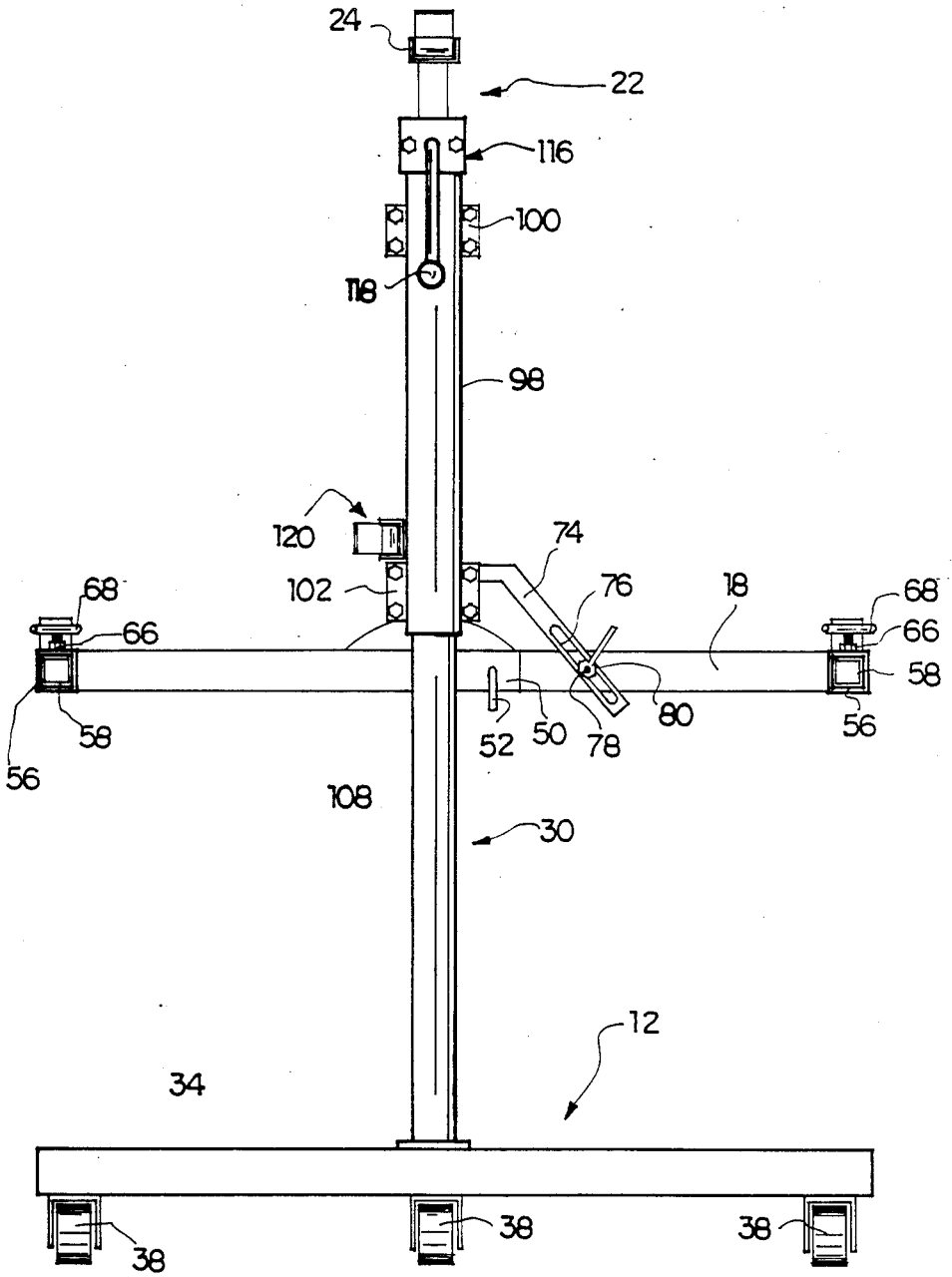
FIG. 3 a rear elevation of the apparatus of FIG. 1.

As illustrated most particularly in FIG. 3, the support tube 98 carries a second clamp 120 near its bottom end, just above the plate 102. The clamp 120 has the same configuration as the clamp 24 and is used alternatively with the clamp 24 to clamp the webbing strap 26 where parts to be handled by the apparatus are of relatively low height, for example, bumpers. This allows the part to be supported on the cradles and held tight on the apparatus with the strap 26 and hook 28.

Figure 4:
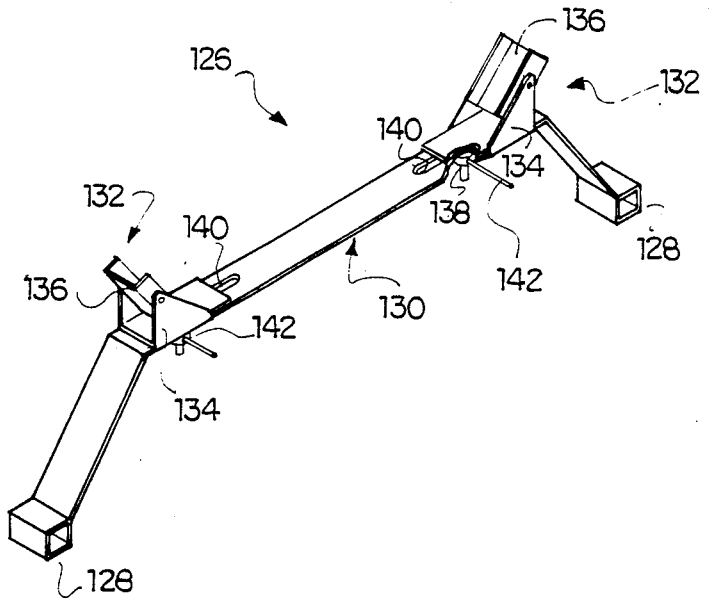
FIG. 4 is an isometric representation of wheel well attachment for the apparatus.

FIG. 4 of the accompanying drawings illustrates a wheel well attachment that is used where the apparatus is intended to support a fender, a pick up truck box or the like. In the case of the pick up truck box, the apparatus will usually be used in pairs, with one apparatus on each side of the box.

The wheel well attachment 126 has two square cradle sleeves 128 that fit over the cradle shanks 58 in front of the sleeves 56. An upwardly offset beam 130 joins the cradle sleeves and carries two spaced wheel well supports 132. Each support includes a channel 134 seated on the top of the beam 130. A short channel section 136 is pivotally mounted in the channel 134 so that it can pivot freely about an axis parallel to the cradle sleeves 128. The channel 134 carries a stud 138 fitted into a slot 140 in the beam 130. This allows the supports 132 to be adjusted towards and away from one another on the beam and locked in place using wing nuts 142 on the underside of the beam.

In use of the wheel well attachment, the attachment is fitted onto the cradle shanks 58 in front of the sleeves 56 and the channels 136 are fitted into the wheel well of the part to be supported. The freely pivotal and laterally adjustable channels provide universal support for car and truck wheel wells.

In using the apparatus otherwise, the cradles 20 are used to support a part from below. Where the part has an an appropriate edge, the edge can be engaged in the support notches 64 of the cradles. Otherwise, the part can be supported directly on the cradle shanks 58. The part is firmly held in position against the bumper strip 29 through use of the strap 26 and hook 28. The hook is a broad, large radius hook that is capable of engaging over the tops and edges of most body parts. In the case of larger parts, such as fenders and doors, the strap will be associated with the head clamp 24 to draw the part against the bumper strip 29, which acts against the body part to maintain tension in the strap. Where smaller or low height components are to be handled, the alternative second clamp 120 may be employed. Use of the jack 30 allows the height adjustment of the support unit to accommodate the heights of parts to be removed, installed or serviced. The cross arm may also be tilted from side to side to accommodate non-horizontal body parts as necessary.

While one embodiment of the invention has been described in detail in the foregoing, it is to be understood that other embodiments are possible without departing from the scope and spirit of the invention. The invention is to be considered limited solely by the scope of the appended claims.

I claim:

1. An apparatus for supporting parts of automobile bodies comprising:

(a) a base including means for supporting the base for travel over a floor;

(b) a standard secured to the base and extending upwardly therefrom;

(c) a support unit mounted on the standard for movement up and down along the standard, the support unit including:

(i) a cross arm adjacent the bottom end of the support unit and carrying cradle means for supporting a body part from below, the cradle means comprising two independent support cradles, cradle mounting means mounting the cradles on the cross arm, in front of the cross arm and adjacent opposite ends thereof for independent movement of the cradles towards and away from the cross arm, and means for selectively securing the cradles to the cross arm, (ii) a head spaced above the cross arm and including an elongate flexible tension means, a body part engaging hook means carried by the tension means and a clamp for selectively clamping the tension means to the support unit, and (iii) resilient bumper means extending between the cross arm and the head for engaging a body part and biasing the part away from the head whereby tension is applied to the tension means; and (d) jack means mounted on the base and coupled to the support unit for selectively raising and lowering the support unit on the standard.

2. Apparatus according to claim 1 wherein the tension means comprise a belt.

3. Apparatus according to claim 2 wherein the belt is a webbing belt.

4. Apparatus according to claim 3 wherein the clamp comprises a lever operated cam clamp.

5. An apparatus for supporting parts of automobile bodies comprising:

(a) a base including means for supporting the base for travel over a floor;

(b) a standard secured to the base and extending upwardly therefrom;

(c) a support unit mounted on the standard for movement up and down along the standard, the support unit including:

(i) a cross arm adjacent the bottom end of the support unit and carrying cradle means for supporting a body part from below, (ii) an elongate flexible tension means and a body part engaging hook means carried by the tension means, (iii) a plurality of vertically spaced clamps for selectively clamping the tension means to the support unit, at least one of said clamps comprising a head spaced above the cross arm and (iv) resilient bumper means extending between the cross arm and the head for engaging a body part and biasing the part way from the head whereby tension may be applied to the tension means; and (d) jack means mounted on the base and coupled to the support unit for selectively raising and lowering the support unit on the standard.

6. An apparatus for supporting parts of automobile bodies comprising:

(a) a base including means for supporting the base for travel over a floor;

(b) a standard secured to the base and extending upwardly therefrom;

(c) a support unit mounted on the standard for movement up and down along the standard, the support unit including:

(i) a cross arm adjacent the bottom end of the support unit and carrying cradle means for supporting a body part from below, (ii) a head spaced above the cross arm and including an elongate flexible tension means, a body part engaging hook means carried by the tension means and a clamp for selectively clamping the tension means to the support unit, and (iii) resilient bumper means comprising a resilient spring strip spaced to a front side of the standard and extending between the cross arm and the head for engaging a body part and biasing the part away from the head whereby tension is applied to the tension means; and (d) jack means mounted on the base and coupled to the support unit for selectively raising and lowering the support unit on the standard.

7. An apparatus for supporting parts of automobile bodies comprising:

(a) a base including means for supporting the base for travel over a floor;

(b) a standard secured to the base and extending upwardly therefrom;

(c) a support unit mounted on the standard for movement up and down along the standard, the support unit including:

(i) a cross arm adjacent the bottom end of the support unit and carrying cradle means for supporting a body part from below, (ii) a head spaced above the cross arm and including an elongate flexible tension means, a body part engaging hook means carried by the tension means and a clamp for selectively clamping the tension means to the support unit, (iii) resilient bumper means extending between the cross arm and the head for engaging a body part and biasing the part away from the head whereby tension is applied to the tension means, and (iv) cross arm tilting means for varying the horizontal orientation of the cross arm with respect to the standard; and (d) jack means mounted on the base and coupled to the support unit for selectively raising and lowering the support unit on the standard.

8. Apparatus according to claim 7 wherein the cross arm tilting means comprise a pivot joining the cross arm to a cross arm support and an adjustable brace connected to the cross arm and the cross arm support.

9. Apparatus according to claim 1 wherein the cradle mounting means comprise sleeves extending across the cross arm, respective cradle support arms slideable in the sleeves and carrying the respective cradles, and means for selectively securing the cradle support arms to the sleeves.

10. Apparatus according to claim 1 wherein the standard comprises a tube secured to the base.

11. Apparatus according to claim 10 wherein the support unit includes a head tube slideable in the standard tube and carrying the clamp, a cross arm support sleeve slideable along the standard tube and means coupling the head tube and the cross bar support sleeve.

12. Apparatus according to claim 11 wherein the means coupling the head tube and the cross bar support sleeve comprise a support tube positioned on a back side of the standard.

13. Apparatus according to claim 12 wherein the jack means comprise means for raising and lowering the support tube on the base.

14. Apparatus according to claim 13 wherein the jack means includes a jack tube telescopically engaged with the support tube and a screw jack engaging the support and jack tubes.

15. An apparatus for supporting parts of automobile bodies comprising:

(a) a base including means for supporting the base for travel over a floor;

(b) a standard secured to the base and extending upwardly therefrom;

(c) a support unit mounted on the standard for movement up and down along the standard, the support unit including:

(i) a cross arm adjacent the bottom end of the support unit and carrying cradle means for supporting a body part from below;

(ii) a head spaced above the cross arm and including an elongate flexible tension means, a body part engaging hook means carried by the tension means and a clamp for selectively clamping the tension means to the support unit, and (iii) resilient bumper means extending between the cross arm and the head for engaging a body part and biasing the part away from the head whereby tension is applied to the tension means;

(d) jack means mounted on the base and coupled to the support unit for selectively raising and lowering the support unit on the standard; and (e) a wheel well support adapted to be mounted on the cross arm for engaging an inside edge of a wheel well of an automobile body.

16. Apparatus according to claim 15 wherein the wheel well support comprises a pair of wheel well cradles and means adjusting the wheel well cradles towards and away from one another.

17. Apparatus according to claim 1 wherein each cradle comprises a first plate, projecting vertically upwardly and a second plate sloping upwardly and away from the first plate, towards the cross arm.

* * * * *